US006761668B1

(12) United States Patent
Chang

(10) Patent No.: US 6,761,668 B1
(45) Date of Patent: Jul. 13, 2004

(54) SPEED CONTROL DEVICE WITH CONTACT SWITCH FOR A TREADMILL

(75) Inventor: Chih-Yuan Chang, Taichung Hsien (TW)

(73) Assignee: Alilife Industrial Co., Ltd., Taichung City (TW)

( * ) Notice: Subject to any disclaimer, the term of this patent is extended or adjusted under 35 U.S.C. 154(b) by 13 days.

(21) Appl. No.: 10/327,013

(22) Filed: Dec. 24, 2002

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS 5,707,319 A * 1/1998 Riley ..... 482/54
5,800,314 A * 9/1998 Sakakibara et al. ..... 482/54
6,416,444 B1 * 7/2002 Lim et al. ..... 482/54

* cited by examiner

*Primary Examiner*—Glenn E. Richmon
(74) *Attorney, Agent, or Firm*—Rosenberg, Klein & Lee

(57) ABSTRACT

A speed control device for a treadmill includes at least one contact switch mounted on a corresponding one of the arms of the treadmill and causing an analogy signal when a user touches the at least one contact switch. A control circuit assembly is mounted in the treadmill and electrically connected to the at least one contact switch for receiving the analogy signal transmitted from the at least one contact switch. The control circuit assembly includes a signal transform circuit receiving the analogy signal and transforming the analogy signal into a digital signal. A waveform process circuit receives the digital signal and transforms the digital signal into a 1/0 or 0/1 signal. A signal output circuit receives the 1/0 or 0/1 signal, amplifies and transmits the signal to a central process unit of the treadmill for controlling a speed of the treadmill.

6 Claims, 10 Drawing Sheets

SPEED CONTROL DEVICE WITH CONTACT SWITCH FOR A TREADMILL

BACKGROUND OF THE INVENTION

1. Field of the Invention

The present invention relates to a speed control device, and more particularly to a speed control device with contact switch for a treadmill.

2. Description of Related Art

A conventional treadmill in accordance with the prior art shown in FIG. 10 comprises base member (5), a platform (6) mounted on the base member (5) and having a belt (61) that is movable relative to the platform (6). The base member (5) includes two opposite sides each having a stand (51) upwardly mounted thereon. Each stand (51) has an arm (52) laterally extending from a top portion of the stand (51). A computer (53) is mounted between the two arms (52) and includes multiple keys (531) for user to control the treadmill.

The computer (53) is away from the user because the computer (53) is mounted on the arms (52) and the user runs on the platform (6). Consequently, the user needs to bend his back down to drive the computer (53) during exercising. However, the user is in a harmony posture during exercising. The user is in a movement when exercising and to press the keys (531) in the computer (53) will break the balance of harmony posture such that the user easily falls down when operating the computer (53) to adjust the speed of the treadmill by using keys (531) in the computer.

For solving the above problem, a key-switch (7) is provided to be mounted on the arm (52) and has multiple keys (71) mounted in the key-switch such that the key-switch (7) is closer to the user than the computer to the user for a convenient operation to the treadmill. However, the user still needs to press the keys (71). The above problem is not completely solved.

The present invention has arisen to mitigate and/or obviate the disadvantages of the conventional control device of a treadmill.

SUMMARY OF THE INVENTION

The main objective of the present invention is to provide an improved speed control device with contact switch for a treadmill.

To achieve the objective, the speed control device includes at least one contact switch mounted on a corresponding one of the arms of the treadmill and causing an analogy signal when a user touches the at least one contact switch. A control circuit assembly is mounted in the treadmill and electrically connected to the at least one contact switch for receiving the analogy signal transmitted from the at least one contact switch. The control circuit assembly includes a signal transform circuit receiving the analogy signal and transforming the analogy signal into a digital signal. A waveform process circuit receives the digital signal and transforms the digital signal into a 1/0 or 0/1 signal. A signal output circuit receives the 1/0 or 0/1 signal, amplifies and transmits the signal to a central process unit of the treadmill for controlling a speed of the treadmill.

Further benefits and advantages of the present invention will become apparent after a careful reading of the detailed description with appropriate reference to the accompanying drawings.

DETAILED DESCRIPTION OF THE INVENTION

Figure 1:
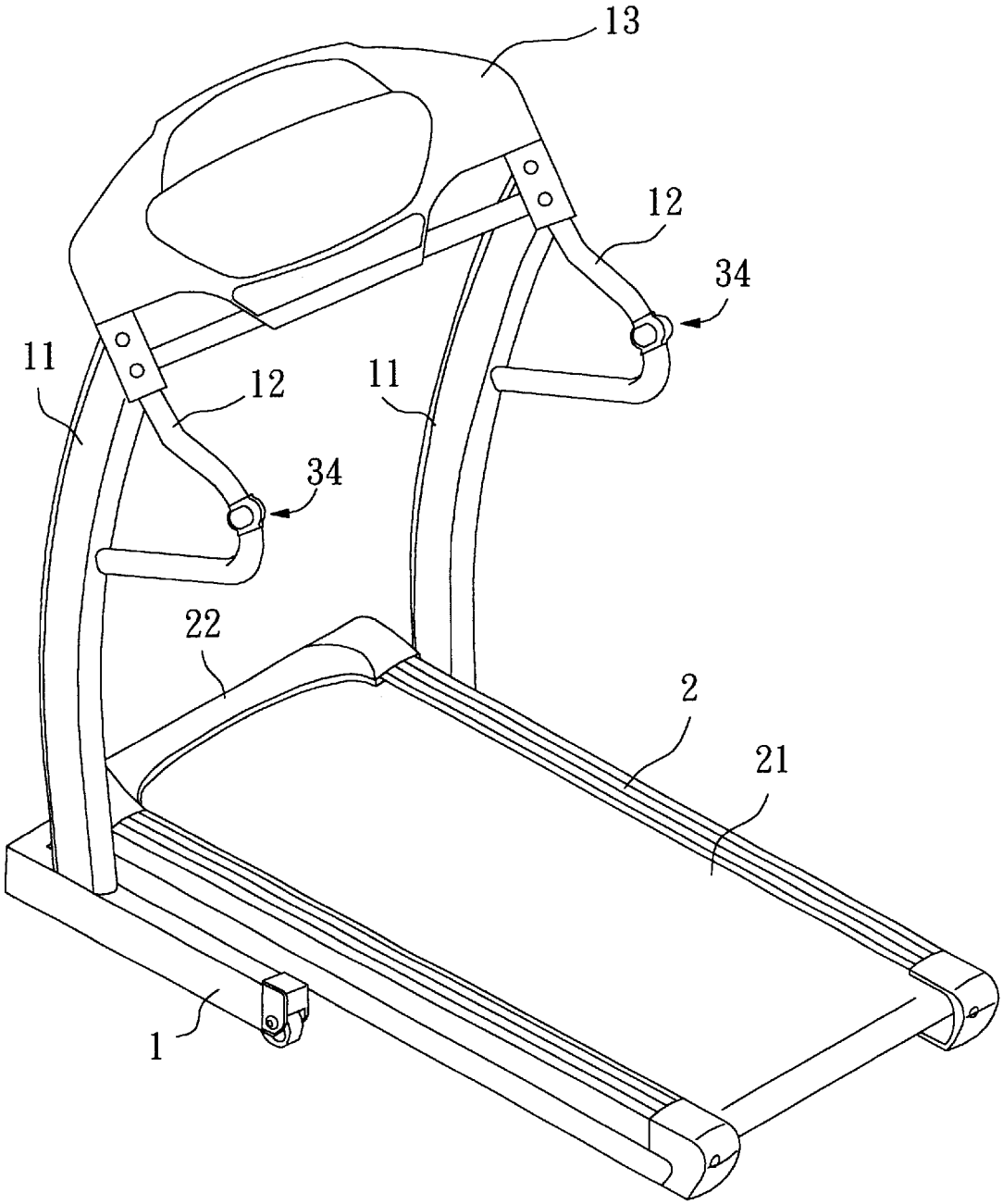
FIG. 1 is a perspective schematic view of a control device with contact switch for a treadmill in accordance with the present invention.
Figure 2:
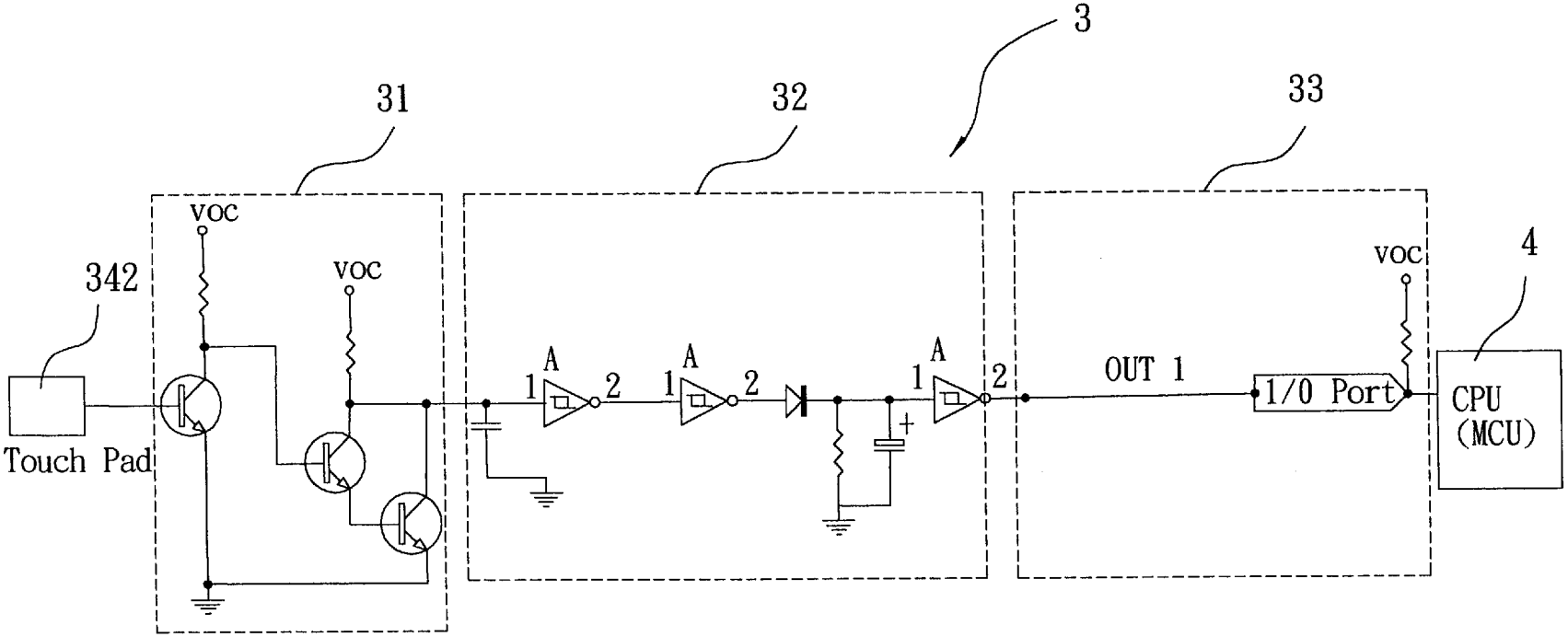
FIG. 2 is a circuit diagram of the control device of the present invention that forms a 1/0 signal.
Figure 3:
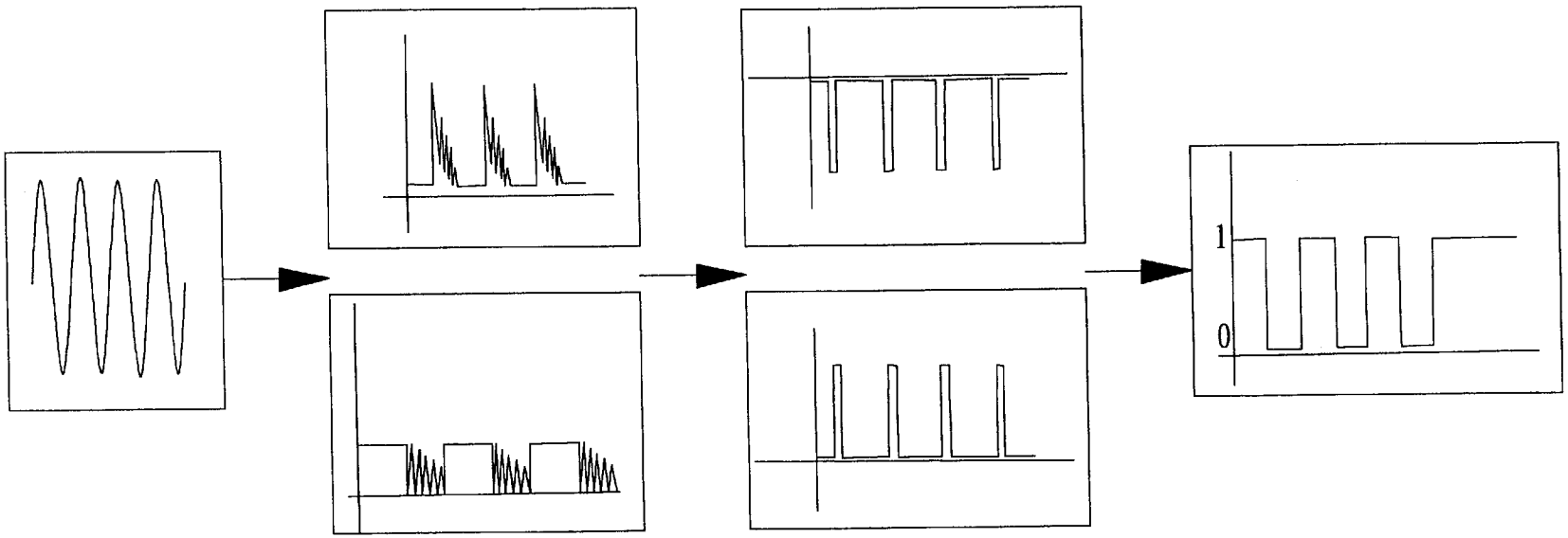
FIG. 3 is an oscillogram of the control device of the present invention.
Figure 4:
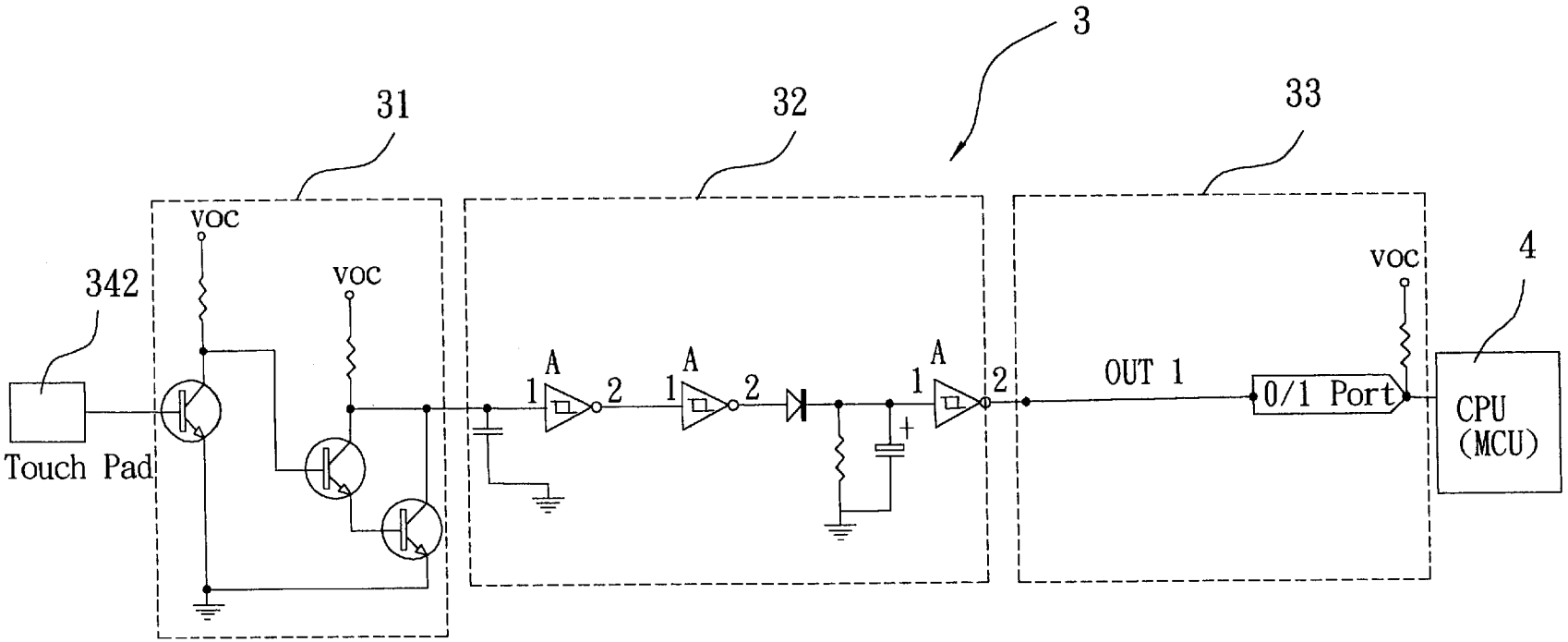
FIG. 4 is a circuit diagram of the control device of the present invention that forms a 0/1 signal.
Figure 5:
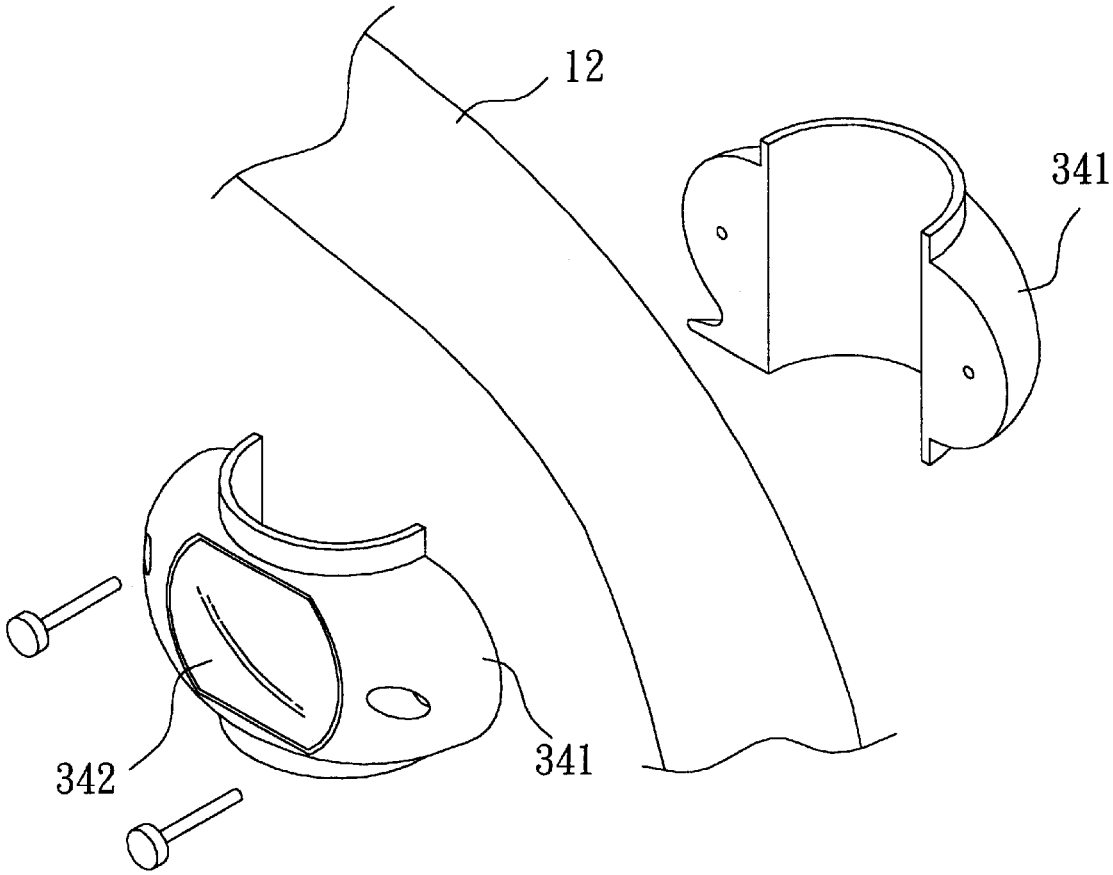
FIG. 5 is an exploded perspective view of a contact switch of the control device of the present invention.

Referring to the drawings and initially to FIGS. 1–5, a control device with contact switch for a treadmill that includes a main frame (10) having two opposite sides each having an arm (11) laterally extending from a top portion of the arm (11), in accordance with the present invention comprises control circuit assembly (3) and at least one contact switch (34) adapted to be mounted on the arm (11) and electrically connected to the control circuit assembly (3).

The control circuit assembly (3) includes a signal transform circuit (31), a waveform process circuit (32) electrically connected to the signal transform circuit (31) and a signal output interface (33) electrically connected to the waveform process circuit (32). The signal transform circuit (31) transforms analogy signals into digital signals that are transformed into 1/0 or 0/1 signals by the waveform process circuit (32). The 1/0 or 0/1 signals are amplified and outputted to a central process unit (CPU) (4) of the treadmill.

The control circuit assembly (3) includes at least one contact switch (34) adapted to be mounted on an outer periphery of the arm (11) of the main frame (1) and electrically connected to the signal transform circuit (31). The contact switch (34) provides an analogy signal to the signal transform circuit when user touches thereon. In the preferred embodiment of the present invention, with reference to FIGS. 5 and 6, the control circuit assembly (3) includes four contact switches (34) and each arm (12) has two contact switches (34) mounted on the arm (12) and oppositely connected to each other. Each contact switch (34) includes a connector (341) and a touch pad (342) secured on the connector (341). The connectors (341) of adjacent contact switches (34) are mounted on each other such that the user can touch the two adjacent contact switches (34) at the same time.

The contact switch (34) causes an analogy signal provided to the signal transform circuit (31) when the touch pads (342) are touched by the user. The signal transform circuit (31) transforms the analogy signal into a digital signal and removes the miscellaneous signal from the contact switch (34). The waveform process circuit (32) transforms the digital signal into a 1/0 or 0/1 signal that is transmitted to the signal output circuit (33) after the digital signal being transmitted to the waveform process circuit (32). The signal output circuit (33) transmits the 1/0 or 0/1 signal to the CPU (4) of the treadmill to adjust the speed or other function of the treadmill.

Figure 6:
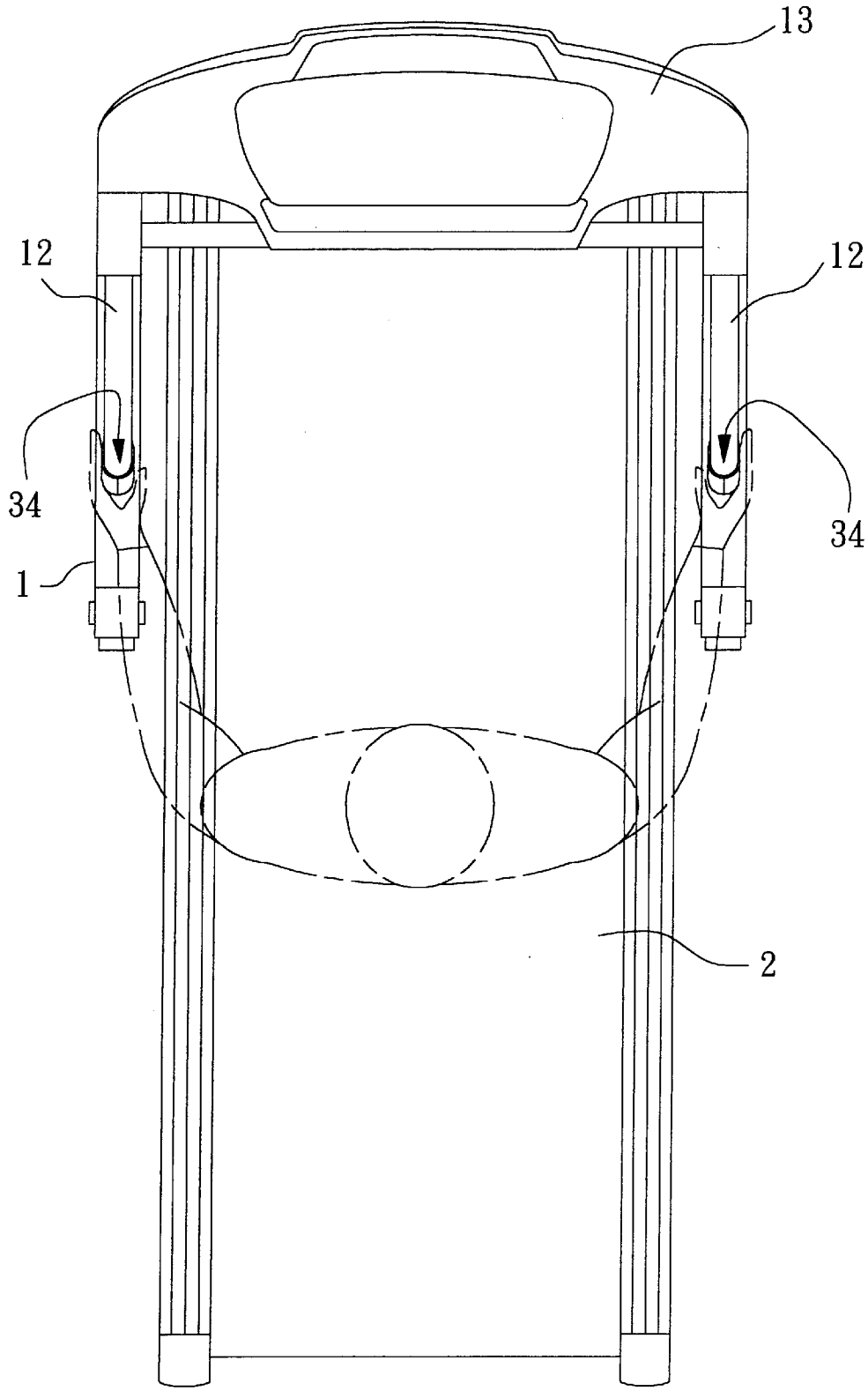
FIG. 6 is operational view of the control device of the present invention.

With reference to FIG. 6, the user only needs to lightly touch the touch pad (342) of the contact switch (34) when adjusting the speed of the treadmill. Consequently, the user can easily adjusts and controls the treadmill during using.

Figure 7:
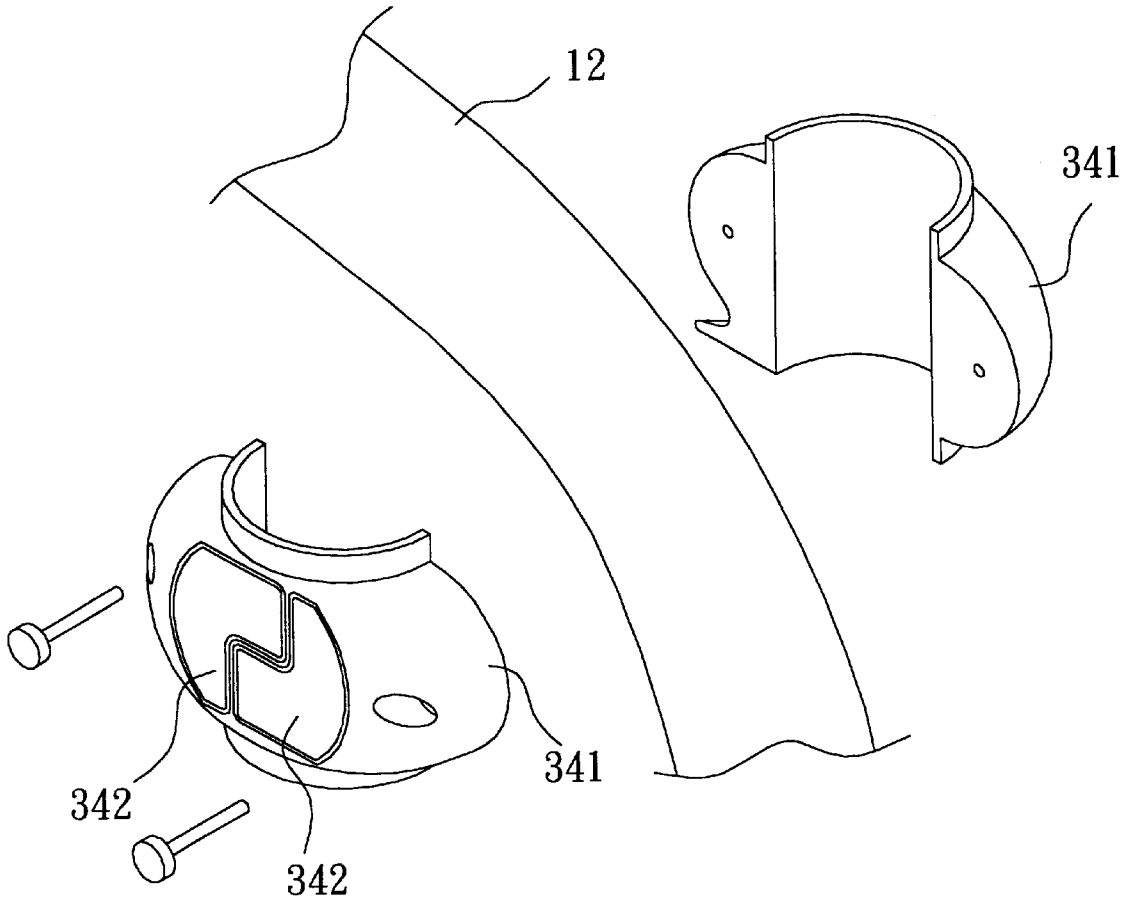
FIG. 7 is an exploded perspective of a second embodiment of the contact switch in accordance with the present invention.
Figure 8:
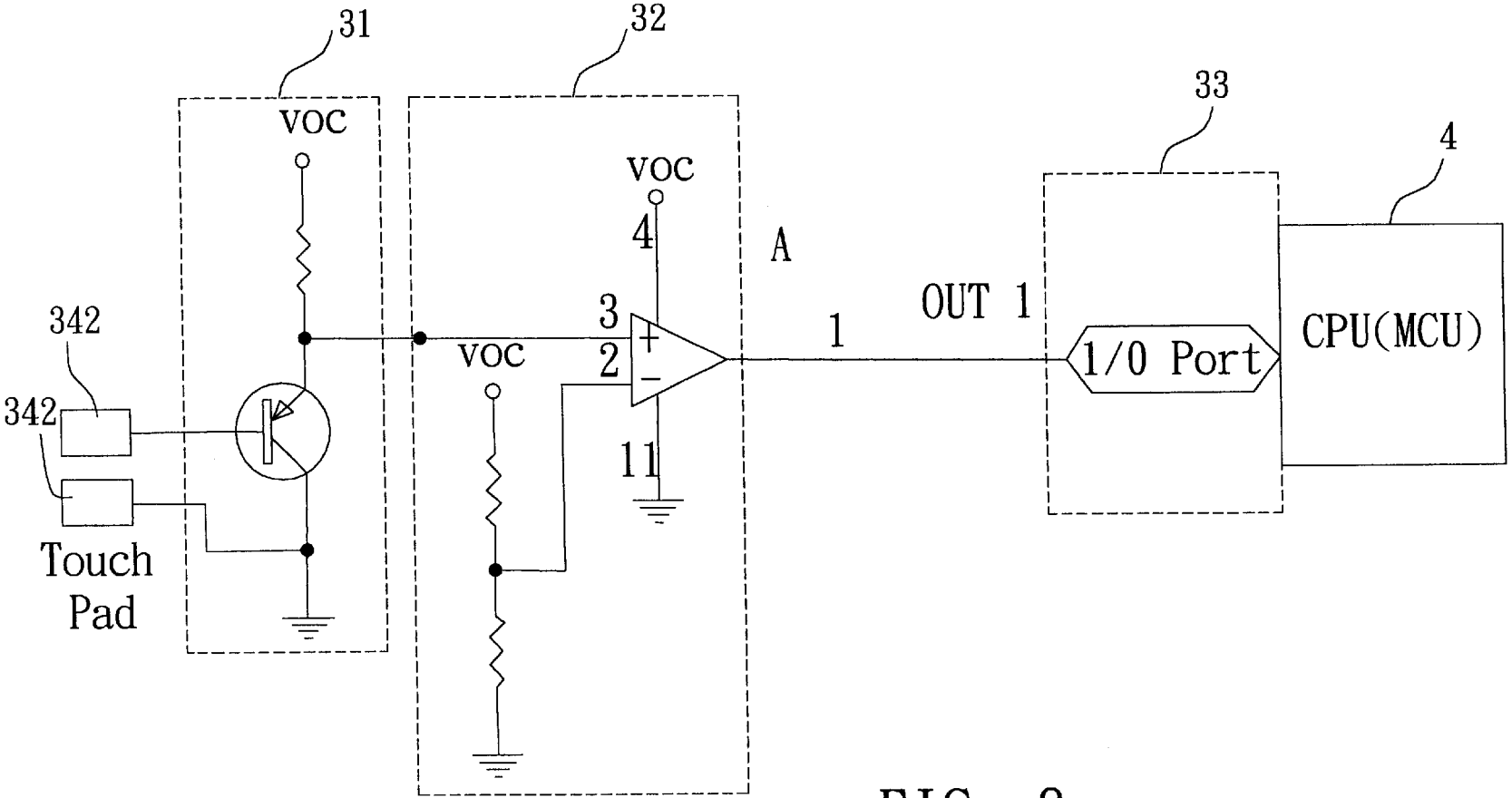
FIG. 8 is a circuit diagram of the second embodiment of the control device of the present invention that forms a 1/0 signal.
Figure 9:
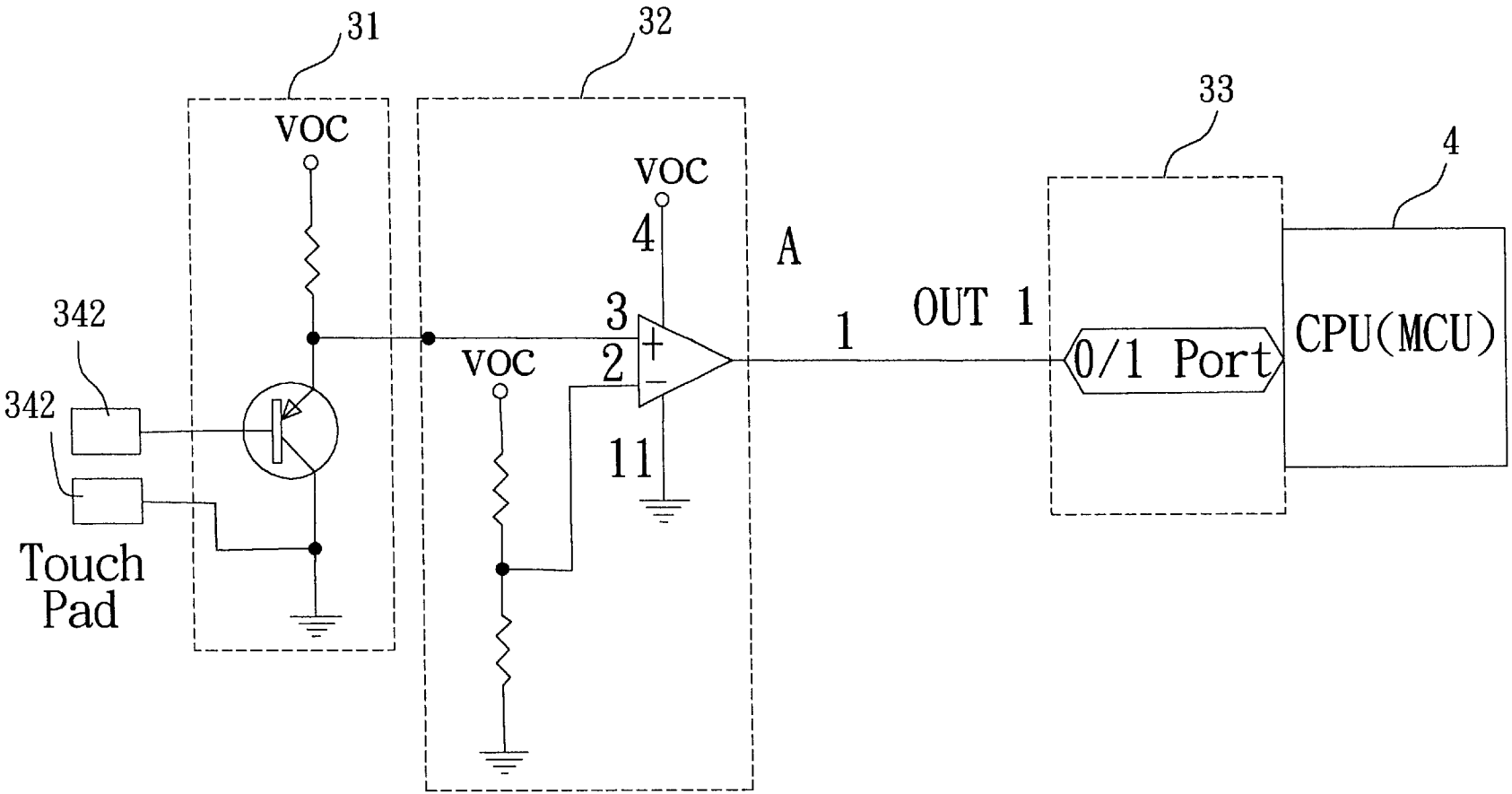
FIG. 9 is a circuit diagram of the second embodiment of the control device of the present invention that forms a 0/1 signal.
Figure 10:
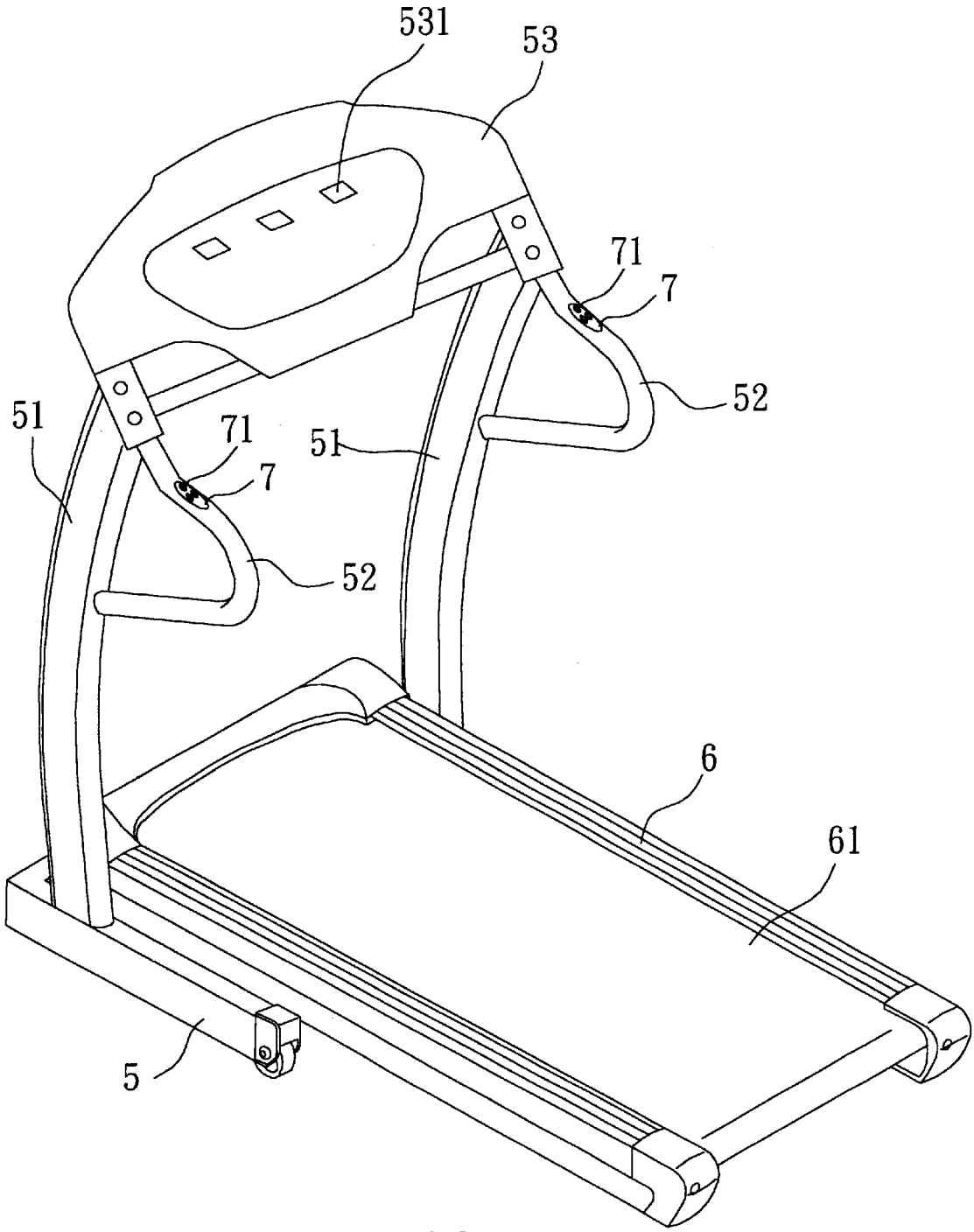
FIG. 10 PRIOR ART
FIG. 10 is a perspective view of a treadmill in accordance with the prior art.

With reference to FIGS. 7 and 9 that shows a second embodiment of the contact switch (34) of the present invention. Each connector (341) has two touch pads (342) mounted thereon. The contact switch (34) will transmit the analogy signal to the signal transform circuit (31) only when the two touch pads (342) on the connector (341) are touched on the same time. The embodiment of the contact switch (34) can prevent the user from mindlessly touching the touch pad (342) and transmitting a signal to the signal transform circuit (31).

Although the invention has been explained in relation to its preferred embodiment, it is to be understood that many other possible modifications and variations can be made without departing from the spirit and scope of the invention as hereinafter claimed.

What is claimed is:

1. A speed control device with contact switch for a treadmill that includes a main frame having two opposite sides each having an arm laterally extending from a top portion of the mainframe, the speed control device comprising:

at least one contact switch adapted to be mounted on a corresponding one of the arms of the treadmill and causing an analogy signal when a user touches the at least one contact switch; and a control circuit assembly adapted to be mounted in the treadmill and electrically connected to the at least one contact switch for receiving the analogy signal transmitted from the at least one contact switch, the control circuit assembly including:

a signal transform circuit receiving the analogy signal and transforming the analogy signal into a digital signal;

a waveform process circuit receiving the digital signal transmitted from the signal transform circuit and transforming the digital signal into a 1/0 signal; and a signal output circuit receiving the 1/0 signal from the waveform process circuit, the signal output circuit adapted to amplify and transmit the 1/0 signal to a central process unit of the treadmill for controlling a speed of the treadmill.

2. The speed control device as claimed in claim 1 comprising two contact switches each adapted to be mounted on a corresponding of two arms of the treadmill, each contact switch including two connector secured connected to each other, each connector having at least one touch pad mounted thereon, wherein the contact switch will transmit the analogy signal to the signal transform circuit when the touch pads are touched at the same time.

3. The speed control device as claimed in claim 2, wherein each connector comprises two touch pads mounted thereon to prevent the user from mindlessly touching the touch pads and transmitting a signal to the signal transform circuit.

4. A speed control device with contact switch for a treadmill that includes a main frame having two opposite sides each having an arm laterally extending from a top portion of the mainframe, the speed control device comprising:

at least one contact switch adapted to be mounted on a corresponding one of the arms of the treadmill and causing an analogy signal when a user touches the at least one contact switch; and a control circuit assembly adapted to be mounted in the treadmill and electrically connected to the at least one contact switch for receiving the analogy signal transmitted from the at least one contact switch, the control circuit assembly including:

a signal transform circuit receiving the analogy signal and transforming the analogy signal into a digital signal;

a waveform process circuit receiving the digital signal transmitted from the signal transform circuit and transforming the digital signal into a 0/1 signal; and a signal output circuit receiving the 0/1 signal from the waveform process circuit, the signal output circuit adapted to amplify and transmit the 0/1 signal to a central process unit of the treadmill for controlling a speed of the treadmill.

5. The speed control device as claimed in claim 4 comprising two contact switches each adapted to be mounted on a corresponding of two arms of the treadmill, each contact switch including two connector secured connected to each other, each connector having at least one touch pad mounted thereon, wherein the contact switch will transmit the analogy signal to the signal transform circuit when the touch pads are touched at the same time.

6. The speed control device as claimed in claim 5, wherein each connector comprises two touch pads mounted thereon to prevent the user from mindlessly touching the touch pads and transmitting a signal to the signal transform circuit.

* * * * *